US005416998A

United States Patent [19]

Martel

[11] Patent Number: 5,416,998

[45] Date of Patent: May 23, 1995

[54] ADAPTER FOR RIFLE MAGAZINE

[76] Inventor: Phillip C. Martel, 48101 Deer Trail Dr., Canton, Mich. 48187

[21] Appl. No.: 150,833

[22] Filed: Nov. 12, 1993

[51] Int. Cl.[6] ..... F41A 9/71; F41A 35/00

[52] U.S. Cl. ..... 42/6; 42/49.02

[58] Field of Search ..... 42/6, 18, 22, 49.01, 42/49.02, 50

[56] References Cited

U.S. PATENT DOCUMENTS 513,647 1/1894 Lee ..... 42/6

4,314,419 2/1982 Koon, Jr. ..... 42/50

*Primary Examiner*—Stephen C. Bentley

*Attorney, Agent, or Firm*—Young, MacFarlane & Wood

[57] ABSTRACT

An adapter for use in an SKS type carbine to permit attachment and detachment of a standard box magazine. The adapter includes a forward latch projection which engages the fixed attachment site of the carbine, and a rear projection, the side edges of which seat on an internal shoulder of the stock of the carbine. The rear projection also includes a cutout portion configured to engage a front portion of the top of the box magazine.

5 Claims, 2 Drawing Sheets

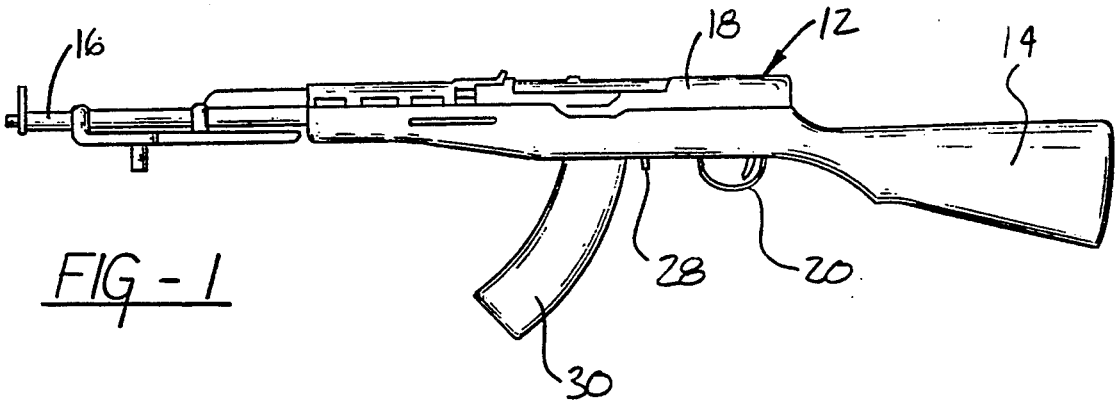
FIG - 1
FIG - 2
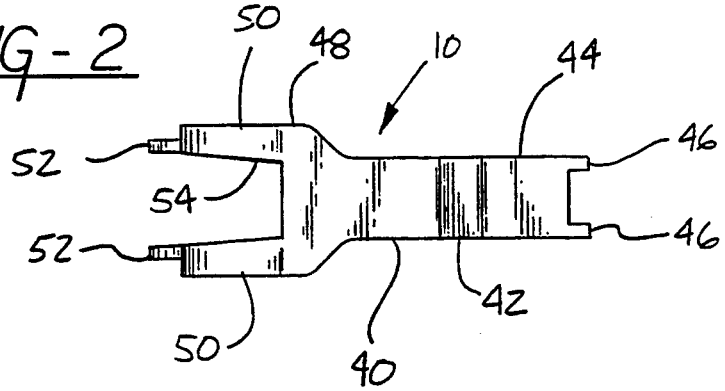
FIG - 3
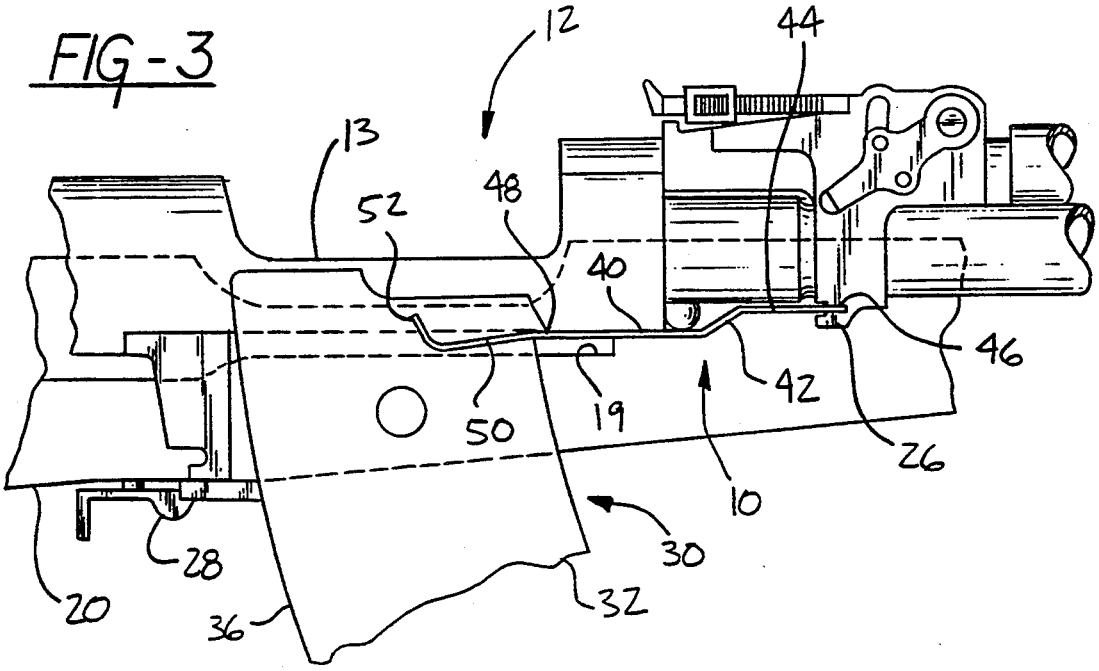

FIG - 4
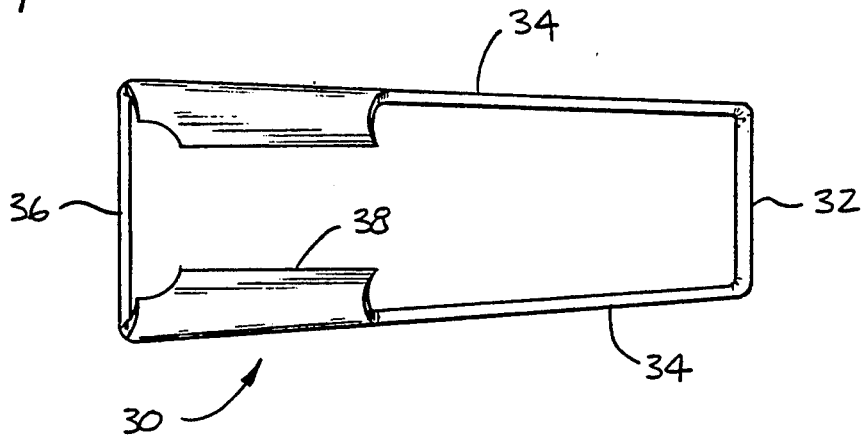
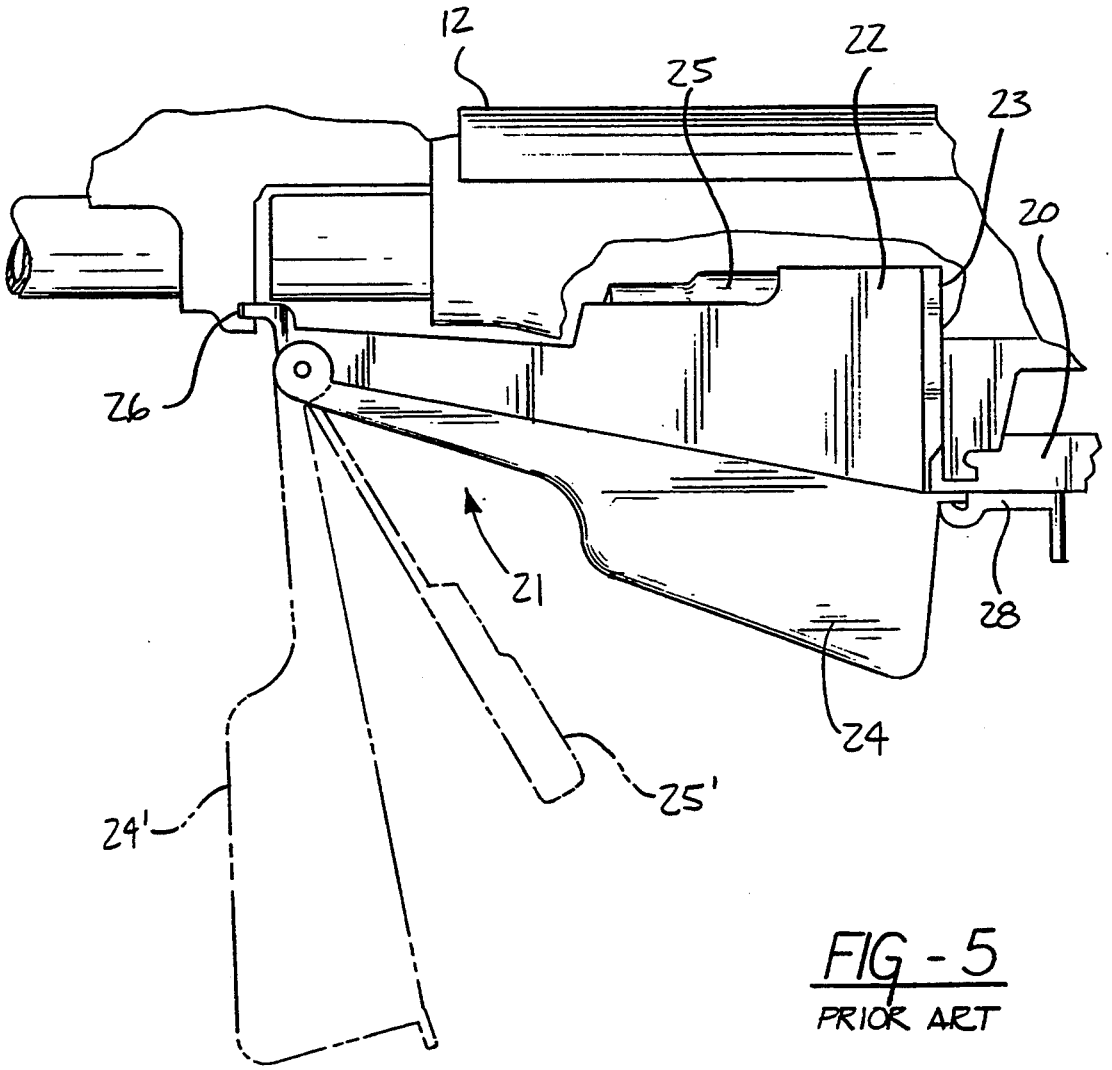
FIG - 5
PRIOR ART

ADAPTER FOR RIFLE MAGAZINE

FIELD OF THE INVENTION

This invention relates to firearms, and more particularly, to an adapter which permits a standard box magazine to be detachably mounted into an SKS type carbine.

BACKGROUND OF THE INVENTION

Semi-automatic rifles and carbines allow multiple cartridges to be fired in a short period of time by simply pulling the trigger as many times as shots are to be fired. The only limitation on the number of rounds fired is the number of cartridges that the weapon will hold in its magazine.

One example of such a semi-automatic carbine is the Soviet designed SKS carbine. This weapon, once a standard in the Soviet army, is also utilized by many European and Asian countries. Carbines of East German, the People's Republic of China, North Korean and Yugoslavian manufacture are currently available in the U.S. marketplace under various designations.

The SKS type carbine has a stock with a vertical through-hole adapted to receive and be covered at its top by a barrel and receiver, at its rear underside by a trigger mechanism, and at its forward underside by the original-equipment magazine. The original-equipment magazine of the firearm has a "clamshell" configuration utilizing a pair of magazine halves connected at a forward pivot site. The upper half of the original-equipment magazine is retained within the stock by various components. The lower half of the original-equipment magazine pivots to allow its interior to be accessed for unloading purposes, cleaning purposes, or the like. A spring-biased magazine retaining latch supported on the trigger mechanism engages a rear portion of the lower half of the original-equipment magazine to retain the original-equipment magazine in a closed configuration during use. Manual sliding of the spring-biased magazine retaining latch rearwardly allows the lower half of the original-equipment magazine to pivot downwardly, thereby opening the magazine.

The original-equipment, clamshell magazine of this weapon holds ten cartridges but is not designed to allow rapid reloading of the rifle. The original-equipment magazine engages a forward fixed attachment site and is secured within the firearm by the trigger mechanism. This prevents the removal of the magazine without the prior removal of the trigger mechanism and thus prohibits the use of preloaded replacement magazines for rapid reloading. Instead, it is necessary to manually reload the original-equipment magazine each time it becomes empty. This is tedious and can create danger for a soldier in a battle setting where it is often desirable to fire more than ten rounds in rapid succession.

Box-type replacement magazines for other weapons are known in the prior art. They provide a source of additional cartridges in the form of preloaded magazines for the associated firearms. Examples of box magazines are disclosed in U.S. Pat. Nos. 1,407,633; 2,081,235; 2,185,676; 3,676,946; and 4,864,758.

My co-pending U.S. patent application Ser. No. 07/553,827 discloses a readily detachable, externally loadable, box magazine adapted to replace the original-equipment box magazine of the SKS type firearm. This replacement magazine includes an elongated extension section attached at one end to the top of the magazine and projecting forwardly therefrom. The extension section is configured to position a forward latch projection from the magazine to engage the same fixed attachment site of the firearm which retains the forward end of the original-equipment magazine. A rear latch projection attached to the rear of the magazine is configured to engage the spring-biased retaining latch of the firearm which is provided to act as a catch for the lower half of the original-equipment magazine. In this manner, the readily detachable magazine utilizes the existing structure of the firearm, but can be removed without disassembly of the firearm.

The readily detachable magazine of my co-pending application may be secured to the firearm by engaging the fixed attachment site and the spring-biased retaining latch of the firearm, and may be removed by disengaging the spring-biased retaining latch of the firearm from the rear latch projection. Further, the extension section substantially covers the underside portion of the stock through-hole forward of the hollow body when the magazine is attached to the firearm. This protects the internal firearm components from damage.

While the magazine disclosed in my co-pending U.S. patent application has enjoyed considerable commercial success, it has obvious disadvantages. In particular, the magazine must be especially manufactured for use with the SKS carbine. Obviously, such a specially manufactured magazine cannot be interchangeably used on other types of weapons. Furthermore, the elongated extension section of the magazine adds considerably to the bulk of the magazine when it is out of the carbine, giving the magazine an awkward configuration for storage.

It would be highly desirable to be able to use a standard box magazine in an SKS carbine, particularly if the standard box magazine could be readily attached to and detached from the weapon. It would also be highly desirable if the rifle used a standard box magazine could be used in other types of rifles and carbines. It would also be highly desirable if a box magazine used in the SKS carbine did not have to be modified so as to present storage problems.

SUMMARY OF THE INVENTION

The invention claimed herein is designed to overcome all of the disadvantages of the prior art noted above. It is an adapter which is insertable into an SKS carbine and permits ready attachment and detachment of a standard box magazine. The adapter is insertable into the vertical through-hole of the stock of the carbine. It includes a unitary body, preferably formed of sheet metal, such as sheet steel, and has a first, forward end and a second, rearward end. A forward latch projection is formed on the forward end of the unitary body and includes a pair of prongs disposed on either side of the body for detachable engagement with the fixed attachment site of the weapon. A rearward projection is formed on the rearward end of the unitary body and includes a portion of increased width which has opposed side edges which seat on an internal shoulder formed in the rifle stock below the receiver so that the edges are sandwiched between the bottom of the receiver and the shoulder. The rearward projection includes a cutaway portion configured to engage the front and portions of the sides of a box magazine proximate the top of the magazine when the magazine is inserted into the through-hole of the stock. The back of the magazine is abutted against the trigger mechanism so that the magazine is detachably held in the carbine.

In a preferred embodiment, the adapter further includes an angled bridge interconnecting the forward latch projection and the rearward projection such that the unitary body is bi-level. That is, the level of the forward latch projection is raised with respect to the level of the rearward projection. This configuration is necessary so that the adapter may conform to the internal structure of the carbine such that the prongs on the forward latch projection will engage with the fixed attachment site, and the edges of the rear projection will seat on the shoulder of the stock.

In another preferred embodiment, the rearward projection further includes a pair of tabs formed on the rear edge thereof proximate the sides thereof. The pair of tabs curves upwardly and terminate in free ends. Again, this configuration helps to hold the adapter firmly within the through-hole of the rifle.

BRIEF DESCRIPTION OF THE DRAWINGS

The following detailed description may best be understood with reference to the following drawings in which:

FIG. 1 is a side view of an SKS type carbine having a standard box magazine attached thereto by means of the present invention;

FIG. 2 is a top plan view of the adapter of the present invention;

FIG. 3 is a side closeup view of the adapter of the present invention in place inside an SKS type carbine with a standard box magazine mounted therein, with certain hidden portions shown in phantom;

FIG. 4 is a top plan view of a standard box magazine having the spring, follower, and bottom plate thereof removed; and FIG. 5 is a side closeup view of the original-equipment magazine of the SKS type carbine, having the stock removed for clarity.

DETAILED DESCRIPTION OF THE PREFERRED EMBODIMENT

Throughout the following detailed description, like numerals are used to reference the same element of the invention shown in multiple figures thereof. With reference to FIG. 1, there is depicted an SKS type firearm 12 having a standard box magazine 30 mounted therein. While the magazine depicted is of the "banana clip" type, other configurations of standard box magazines may be advantageously employed with the present invention. The weapon 12 has a conventional one-piece stock 14 with a vertical through-hole 13 (visible in FIG. 3) adapted to be covered at its top by a barrel 16 and receiver 18. The through-hole 13 is covered at its rear underside by a trigger mechanism 20 and covered at its forward underside by an original-equipment magazine 21, as shown in FIG. 5.

With reference to FIG. 5, the original-equipment magazine 21 of the firearm 12 has a "clamshell" configuration utilizing a pair of magazine halves 22,24 connected at a pivot site. A follower 25 is disposed within the magazine 21 to facilitate the feeding of cartridges to the rifle. The original-equipment magazine 21 engages a forward fixed attachment site 26 and is secured within the firearm by a rear projection 23 being retained by the trigger mechanism 20.

The lower half 24 of the original-equipment magazine 21 pivots downwardly to allow its interior portions to be accessed to unload the magazine or for cleaning purposes. A magazine retaining latch 28 supported on the trigger mechanism 20 is spring-biased into a forward position in which it engages a rear portion of the lower half 24 of the magazine 21 to retain the magazine 21 in a closed configuration during use. Manual pressure in the rearward direction on the spring-biased magazine retaining latch 28 allows the lower half 24 of the original-equipment magazine 21 to pivot downwardly into an open position 24'. This allows follower 25 to pivot downwardly 25' as well.

The replacement banana clip magazine 30 includes front 32, side 34, and back 36 wall members and has a top opening 38 to allow cartridges to pass therethrough into the firearm 12. A spring and follower (not shown) are disposed within the magazine 30 and cooperate to facilitate the extraction of cartridges from within magazine 30 during use of the firearm 12. A top plan view of the magazine 30 is depicted in FIG. 4, the spring, follower and bottom plate of the magazine 30 having been removed to leave simply a hollow body. As can readily be seen, the sides 34 of magazine 30 tapers from a wider back 36 to a smaller front 32.

FIG. 2 is a top plan view of the adapter 10 of the present invention which is also shown in side view installed in the firearm 12 in FIG. 3. The adapter 10 is in the form of a unitary body 40 which includes a forward latch projection 44 having a pair of prongs 46 projecting from the front edge thereof and configured for engagement with the fixed attachment site 26 of the carbine 12.

Unitary body 40 also includes a rearward projection 48 which has a width greater than the rest of the unitary body 40. Side edges 50 are configured to abut and seat on a shoulder 19 which is found on each side of the rifle stock 14. The shoulder 19 is formed due to the fact that a section of the top of the stock must be hollowed out to receive the barrel and receiver of the carbine therein. A similar hollowed-out portion on the bottom of the stock which receives the trigger mechanism and magazine is of somewhat narrower width, thus causing shoulder 19. The present invention takes advantage of the existence of shoulder 19 to provide a secure place for engaging the rearward portion of the adapter 10 of the present invention, the edges 50 of which are sandwiched between the receiver 18 and the shoulder 19.

Preferably, the forward and rearward projections 44,48 are interconnected by means of angled bridge 42, best seen in FIG. 3, such that the unitary body 40 is essentially bi-level. That is, the level of the forward latch projection 44 is higher than the level of the rearward projection 48. Additionally, the side edges 50 taper downward slightly. A cutout portion 54 (best seen in FIG. 2) is configured for engagement with the front 32 and forward portions of the sides 34 of the box magazine 30. As can most clearly be seen by comparing FIGS. 4 and 3, cutout portion 54 is configured to receive the tapering front end of the magazine 30 such that the adapter 60 snugly conforms to the magazine 30, thereby ensuring a secure, but detachable fit. As can be seen in FIG. 3, the back 36 of the magazine 30 abuts against the trigger mechanism 20, thus securing the rear end of the magazine in the carbine.

In another preferred embodiment, the adapter 10 further includes a pair of tabs 52 which are formed on the rear of the rearward projection 48. As can be seen in FIG. 3, these tabs 52 curve upwardly. The bi-level design of the adapter 10, the downward taper of the side edges 50, and the upward curve of the tabs 52 are design elements of the adapter 10 which allow it to conform to the internal configuration of the through-hole 13 of the stock 14 so that the adapter is securely, yet easily, installable in the weapon.

The adapter 10 is installed in the firearm 12 simply by first removing the trigger mechanism 20 and then engaging the prongs 46 with the fixed attachment site 26 of the carbine. (In some models, it may be necessary to maneuver the adapter 10 around a cross-bolt fixture found in the stock). The side edges 50 are then seated within the through-hole 13 such that portions of the side edges 50 abut against the shoulder 19 of the stock 14. This is done by pushing down on the rear of the adapter 10. It may also be necessary to squeeze the edges 50 slightly together while pushing down. The adapter 10 will be held firmly in place by the configuration of the stock and the reinstallation of the trigger group. The box magazine 30 may then simply be inserted into the carbine such that the forward portion of the top of the magazine extends into the cutout portion 54 of the adapter 10 and the rear edge 36 abuts against the trigger mechanism 20. It may be detached by simply pulling it out from the through-hole.

Thus, the present invention allows an SKS type carbine to be adapted for ready attachment and detachment of a standard box magazine. Furthermore, the adapter may be installed in the weapon without the use of any tools, or without modifying the rifle, itself. Thus, it may also be easily removed if one desires to install the original equipment clamshell magazine back in the rifle. Furthermore, the adapter permits the user to interchange use of a standard box magazine between the SKS type carbine and a weapon of a different design, such as an AK-47, with only minor modification.

The present invention has been described with reference to certain exemplifications and embodiments thereof. Doubtless, design changes may occur to one skilled in the art having had the benefit of the teachings of the present invention without departing from the scope thereof. It is the claims appended hereto and all equivalents thereof which define the scope of the present invention, rather than the specific embodiments and exemplifications depicted.

I claim:

1. An adapter insertable into the vertical through-hole of the stock of a carbine of the type originally equipped with a clamshell magazine retained within the stock at the forward end of the magazine at a fixed attachment site on the carbine and at the magazine's rear end to the trigger mechanism of the carbine such that the clamshell magazine may be removed from the carbine only after removal of the trigger mechanism from the stock, said adapter permitting the ready attachment and detachment of a standard box magazine, said adapter comprising:

a unitary body having a first, forward end and a second, rearward end;

a forward latch projection formed on said forward end and including a pair of prongs disposed on either side of said unitary body for detachable engagement with the fixed attachment site of the carbine; and a rearward projection of increased width and having opposed side edges to seat on an internal shoulder of the carbine stock below the receiver of the carbine, said projection including a cutaway portion configured to engage the front and sides of said box magazine proximate the top thereof when said magazine is inserted into said through-hole with the back of the magazine abutting against the trigger mechanism such that said magazine is detachably held in said carbine.

2. The adapter of claim 1 wherein said unitary body further includes an angled bridge interconnecting said forward latch projection and said rearward projection such that the level of said forward latch projection is elevated with respect to the level of said rearward projection.

3. The adapter of claim 1 wherein said rearward projection includes an area proximate the sides of said cutaway portion tapering downward toward the rear of said adapter.

4. The adapter of claim 3 wherein said rearward projection further includes a pair of tabs formed on the rear edge thereof proximate the sides thereof, said pair of tabs curving upwardly to terminate in free ends.

5. An adapter insertable into the vertical through-hole of the stock of a carbine of the type originally equipped with a clamshell magazine retained within the stock at the forward end of the magazine at a fixed attachment site on the carbine and at the magazine's rear end to the trigger mechanism of the carbine such that the clamshell magazine may be removed from the carbine only after removal of the trigger mechanism from the stock, said adapter permitting the ready attachment and detachment of a standard box magazine, said adapter comprising:

a unitary body formed having a first, forward end and a second, rearward end;

a forward end including a pair of prongs extending therefrom and configured to detachably engage the fixed attachment site of the carbine; and a rearward end configured to have side edges which seat on an internal shoulder of the carbine stock below the receiver of the carbine, said rearward end further being configured to engage with the front and sides of said box magazine proximate the top thereof when said magazine is inserted into said through-hole with the back of the magazine abutting against the trigger mechanism such that said magazine is detachably held in said carbine.

* * * * *